US006167743B1

(12) United States Patent
Marritt et al.

(10) Patent No.: US 6,167,743 B1
(45) Date of Patent: Jan. 2, 2001

(54) SINGLE CAM CONTAINER NECKING APPARATUS AND METHOD

(75) Inventors: Clifford R. Marritt, Lynchburg; Ray M. Clem, Rustburg, both of VA (US)

(73) Assignee: Delaware Capital Formation, Inc., Wilmington, DE (US)

( * ) Notice: Under 35 U.S.C. 154(b), the term of this patent shall be extended for 0 days.

(21) Appl. No.: 09/189,945

(22) Filed: Nov. 12, 1998

(51) Int. Cl.[7] ..... B21D 41/04
(52) U.S. Cl. ..... 72/352; 72/466.7; 413/69
(58) Field of Search ..... 72/352, 370.02, 72/379.4, 466.7, 466.9; 413/69

(56) References Cited

U.S. PATENT DOCUMENTS

| | | | | |
|---|---|---|---|---|
| 3,524,338 | | 8/1970 | Bozek . | |
| 3,635,069 | | 1/1972 | Eichenhorst . | |
| 4,280,383 | | 7/1981 | Bryan et al. . | |
| 4,365,499 | * | 12/1982 | Hirota et al. | 72/466.9 |
| 4,446,714 | | 5/1984 | Cvacho . | |
| 4,457,158 | | 7/1984 | Miller et al. . | |
| 4,513,595 | | 4/1985 | Cvacho . | |
| 4,519,232 | | 5/1985 | Traczyk et al. . | |
| 4,693,108 | | 9/1987 | Traczyk et al. . | |
| 4,732,027 | | 3/1988 | Traczyk et al. . | |
| 5,018,379 | | 5/1991 | Shirai et al. . | |
| 5,249,449 | * | 10/1993 | Lee et al. | 72/379.4 |
| 5,479,900 | | 1/1996 | Bodenhausen et al. . | |

FOREIGN PATENT DOCUMENTS

| | | | | |
|---|---|---|---|---|
| 1-210135 | * | 8/1989 | (JP) | 72/379.4 |

* cited by examiner

*Primary Examiner*—Lowell A. Larson
(74) *Attorney, Agent, or Firm*—Foley & Lardner

(57) ABSTRACT

A container necker has a necking die moved into contact with a container workpiece by a cam and a pilot urged toward the container by compressed air on a floating piston on which the pilot is mounted. The pilot is held in contact with the necking die by the air pressure acting on the floating piston and follows the necking die in unison into contact with the container. Compressed air flows through the pilot to inflate the container to increase its rigidity during necking. A radial surface on the pilot is engaged by the end of the container to stop the pilot while the necking die continues to the end of its travel to complete the necking function. In a second embodiment the necking die is fixedly positioned and the workpiece is axially moved relative to the die to effect the necking function.

15 Claims, 7 Drawing Sheets

SINGLE CAM CONTAINER NECKING APPARATUS AND METHOD

BACKGROUND OF THE INVENTION

The present invention relates to the field of metal container necking apparatus and methods used in the tapered reduction of the diameter of the top portion of beverage and other type metal containers. More specifically, the invention relates to a new and improved, simplified and less expensive necking apparatus and method providing enhanced functional results for necking metal containers such as beverage containers in which only one cam is employed for actuating and driving the tooling to effect the necking function.

A variety of prior art methods and devices have been employed for necking metal containers. The known prior art devices employ a cylindrical necking die which is reciprocated axially to engage the exterior of the upper end of a container workpiece and a coaxial die pilot also, known as a "knockout" or "pilot" which simultaneously moves axially in a mating manner into the open end of the container workpiece. The aforementioned prior art devices have employed a variety of complicated and expensive drive arrangement including a first cam for driving the necking die and a second cam for driving the pilot die.

While many of the prior devices have provided satisfactory results and have been capable of operating at progressively higher speeds during the recent years, such devices have been increasingly complex in construction and have been extremely expensive to manufacture and maintain.

For example, Lee at al. U.S. Pat. No. 5,249,449 discloses a can necking apparatus of complex construction in which a necking die 30 and a pilot 148 are reciprocated in unison into contact with a can body 12 that is pressured with air. The pilot 148 and the necking die 30 are capable of axial movement relative to each other and forward movement of the pilot is terminated by engagement of flange 88 with a bumper ring 92 as shown on the left end of FIG. 1 of the Lee et al. patent. However, the necking die 30 continues forward movement after forward movement of the pilot has been terminated. Thus, substantial vibration and noise as well as complexity of construction render the device of this patent to be expensive to construct and maintain. The device of the Lee patent is additionally deficient in that it is incapable of operating at high speeds comparable to other conventional necking devices.

Similarly, Miller et al. U.S. Pat. No. 4,457,158 is directed to a can necking apparatus employing a complex mechanically driven structure for effecting container necking by moving a die member 30 and a pilot 40 forwardly into the open end of a container workpiece. The pilot 40 has its forward travel terminated by engagement of its surfaces 46*a* and 47*a* with surfaces with 20*b* of the base 20 of the apparatus. Here again, noise and vibration are substantial problems which limit the speed of operation and reliability of the device.

Additionally, there are a wide variety of can necking machines employing two separate cams for respectively moving the pilot and the necking die members as exemplified by a number of U.S. and foreign patents.

Therefore, the primary object of the present invention to provide a new, improved, and reliable can necking apparatus which is less complex than prior known can necking devices.

A further object of the present invention is the provision of a new and improved can necking method and apparatus of simplified construction in which only a single cam is required for operating the necking tooling.

SUMMARY OF THE INVENTION

Obtainment of the foregoing objects of the present invention is enabled by two embodiments of the invention. In the first embodiment a conventional vacuum or conventional non-vacuum starwheel is provided on a driven main shaft for positioning and holding a cylindrical container workpiece, usually formed of aluminum but can be of other materials, in axial alignment with tooling comprising a coaxial pilot and necking die. Hereinafter the term starwheel can mean either vacuum or conventional starwheels. The necking die and pilot are mounted on a cam driven ram mounted for axial reciprocation on a continuously rotating turret which is fixedly attached to the driven main shaft. The pilot and necking die are coaxially positioned relative to the container workpiece and rotate in unison with the starwheel. The closed or bottom end of the container workpiece is engaged with a fixed radial stop forming part of the starwheel so that the container workpiece is held in proper axial position for working and cannot move axially away from the necking die.

The necking die assembly is mounted on a tool carrier member mounted on one end of a cam driven ram which is mounted for rotation on and with the turret. The ram, tool carrier member and necking die are moved forwardly from a home or retracted position toward the open end of the container workpiece so that the necking die engages the outer periphery of the open end of the container workpiece while the pilot enters the interior of the workpiece in well-known manner. Such movement of the necking die is effected by cam follower means on the ram which engages a fixedly positioned cam about which the cam follower means orbits due to rotation of the turret. As the necking die is being moved forwardly toward the container workpiece, air pressure in a cylindrical air chamber in the tool carrier urges a floating piston positioned in the air chamber forwardly toward the workpiece. The pilot is mounted on the forward end of the floating piston and a forwardly facing radial surface of the floating piston engages and remains in contact with a rear portion of the necking die assembly so that the pilot follows the necking die as the necking die moves forwardly from its home or retracted position toward and into contact with the outer surface of the open end of the container workpiece. Additionally, an axial bore provided internally of the floating piston provides compressed air to the interior of the container workpiece prior to and after the necking die engages the can so as to insure positioning of the base of the container workpiece against the fixed stop on the starwheel and to pressurize and consequently strengthen the container workpiece to aid in preventing distortion of the container workpiece during the necking operation.

Movement of the pilot forwardly toward the container workpiece is terminated by engagement of the open container workpiece end edge with a radial stop surface on the pilot to terminate further forward axial movement of that pilot inwardly of the container workpiece. However, the necking die continues its axial movement under the driving force of the cam follower means until the necking function is completed. Following completion of the forward movement of the necking die, the cam and cam follower reverse the direction of movement of the necking die so that it is moved rearwardly away from the can and engages the forwardly facing radical surface of the floating piston which, along with the pilot, is in its stopped position in contact with the open can. Continued movement of the necking die moves the floating piston and pilot rearwardly toward their original starting position. Meanwhile, the pressurized air in the container workpiece, aids in ejecting the container workpiece from the necking die and the pilot for subsequent removal by the starwheel to an outfeed conveyor.

In the second embodiment, the container workpiece is moved into contact with the necking die which is fixedly positioned on the turret with the sequence of working functions being the same as in the first embodiment.

Thus, the inventive structure is greatly simplified in that only a single drive cam is employed and the necking die and the pilot are not mechanically connected by springs or other means and are free for limited relative axial movement with respect to each other. The simplicity of the construction results in substantial cost savings in both fabrication and maintenance of the apparatus.

BRIEF DESCRIPTION OF THE DRAWINGS

The invention will be better understood by reading the following detailed description of the preferred, but not sole, embodiment of the invention with reference to the accompanying drawing figures in which like reference numerals refer to like elements throughout, and in which.

DETAILED DESCRIPTION OF THE PREFERRED EMBODIMENT

Figure 1:
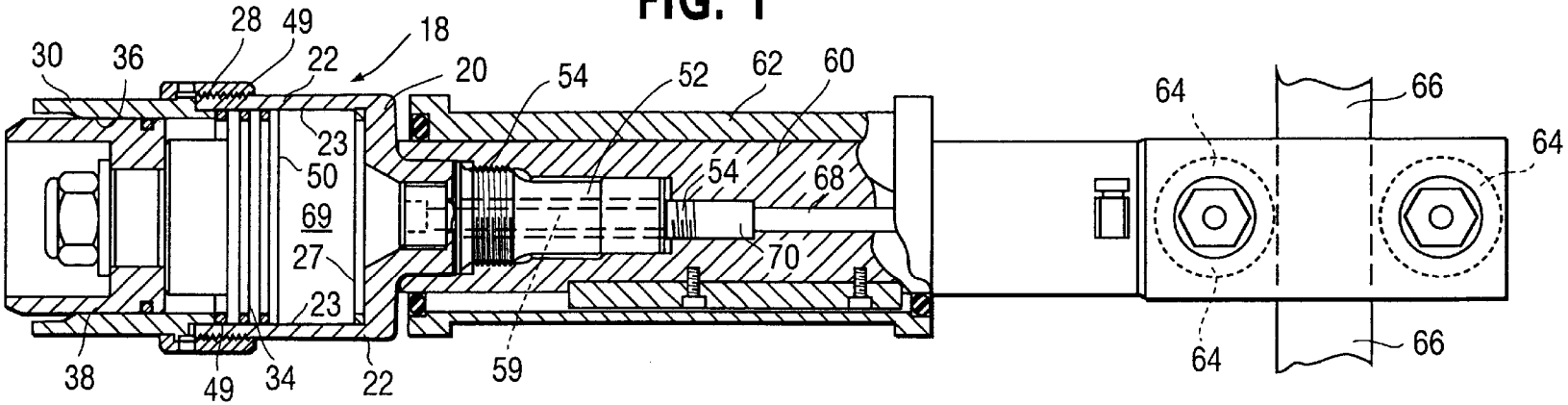
FIG. 1 is a bisecting longitudinal section of a first embodiment at time $T_1$ at the beginning of a cycle of operation which illustrates the ram, the necking die and pilot etc. in the retracted starting or home or cycle start position in which air pressure on the floating piston holds pilot is in its forwardmost (leftward) position relative to the necking die.

In describing preferred embodiment of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

Figure 2:
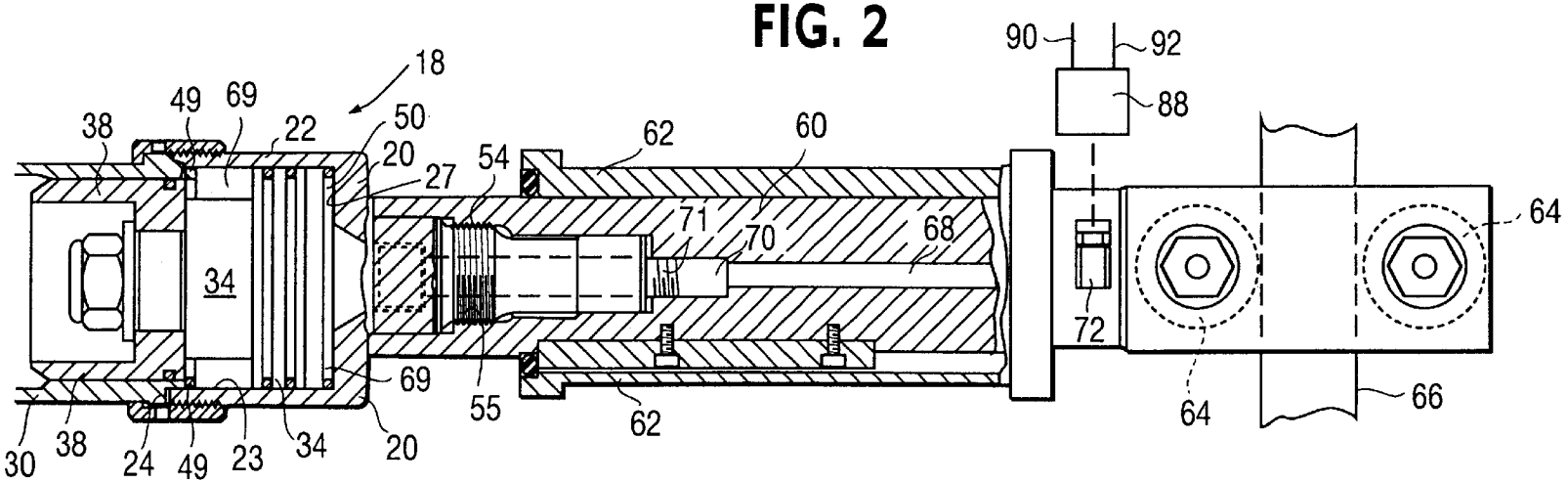
FIG. 2 is a bisecting sectional view similar to FIG. 1 illustrating the necking die in its most forward limit position of movement with the floating piston and pilot being in their rearward limit position relative to the necking die.
Figure 9:
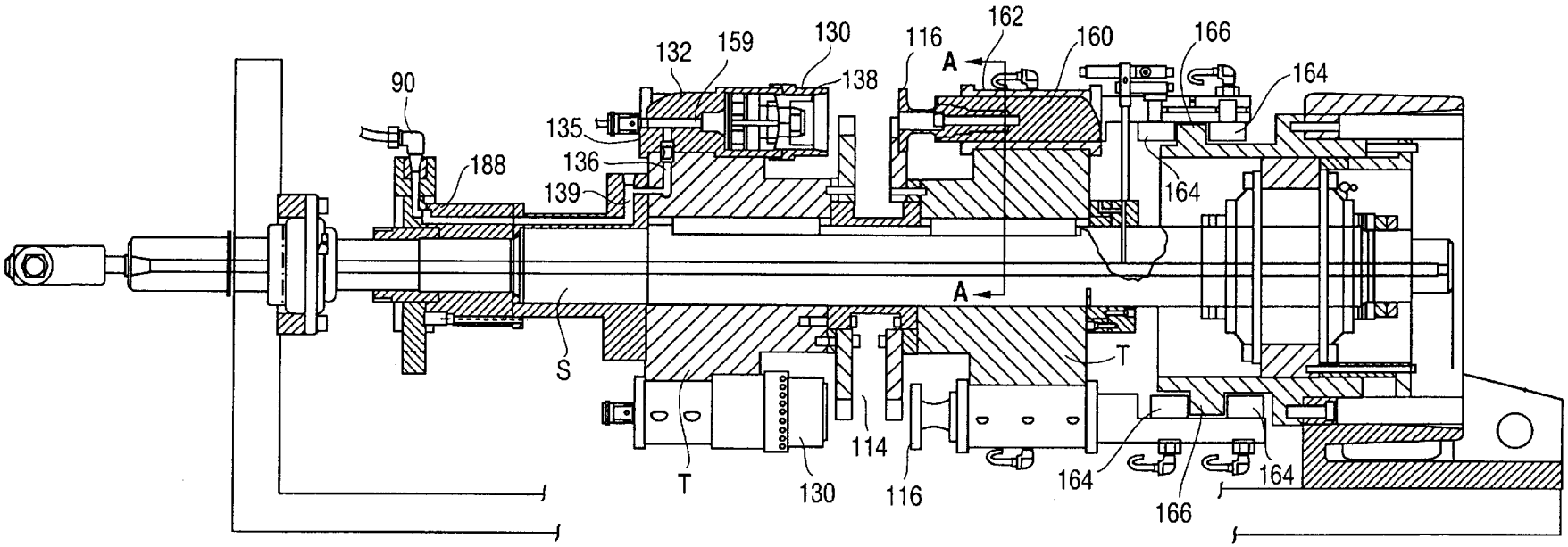
FIG. 9 is a bisecting sectional view of the second embodiment of the invention in which the necking die is fixedly positioned on the turret and the workpiece is moved axially into contact with the necking die and the pilot.

The preferred embodiment of the invention comprises an apparatus for necking a container workpiece 12 (FIG. 3) supported on a continuously rotating starwheel 14 which is mounted on a turret T, of the type shown in FIG. 9 as used in the second embodiment which is mounted on a driven main drive S also as shown in FIG. 9. The turret and drive shaft are conventional items such as those employed in Model 595 neckers sold by Belvac Production Machinery, Inc. of Lynchburg, Va. The starwheel includes a radial backup member 16 engageable with the closed lower end of the container workpiece 12 for precluding movement of the workpiece in a forward direction (to the left) away from moveable necking apparatus generally designated 18 as shown in FIG. 2.

The moveable necking apparatus 18 includes a tool carrier member 20 (FIG. 2) which includes a cylindrical portion 22 having an internal air chamber 69 defined by cylindrical bore surface 23 and a radial forwardly facing surface 27. A floating piston 34 (FIG. 8) is positioned in air chamber 69 and is attached to a pilot 38 as shown in FIG. 2 for urging the pilot forwardly toward the workpiece container 12. End surface 24 as shown in FIG. 1A defines the forward end of tool carrier member 20. It should be understood that the directional term "forwardly" refers to the movement to the left of the moving necking apparatus 18 as viewed in FIGS. 1, 2, 3, 4, 5, etc. Similarly, the term "rearwardly" refers to movement to the right in the opposite direction. Thus, forward movement is movement in a direction toward the container 12 whereas rearward movement is movement in a direction away from the container 12.

The outer end surface of the cylindrical portion 22 of the tool carrier member 20 is provided with threads 26 (FIG. 1A) on which a threaded retainer ring 28 is threadably mounted for fixedly holding a necking die 30 in position on the forward end of tool carrier member 20. Necking die 30 is of cylindrical configuration and has an inwardly facing working surface 32 which is contoured to engage the outer surface of the container workpiece 12 for necking the outer end inwardly in a manner well known in the art. The necking die work surface 32 is configured in accordance with the configuration of the container which is desired to be provided by the apparatus and can consequently vary in shape and is not limited to the shape and configuration illustrated in the drawings. Necking die 30 has a cylindrical bore 36 axially positioned relative to the die and extending rearwardly from the rearward termination of the working surface 32.

Figure 1A:
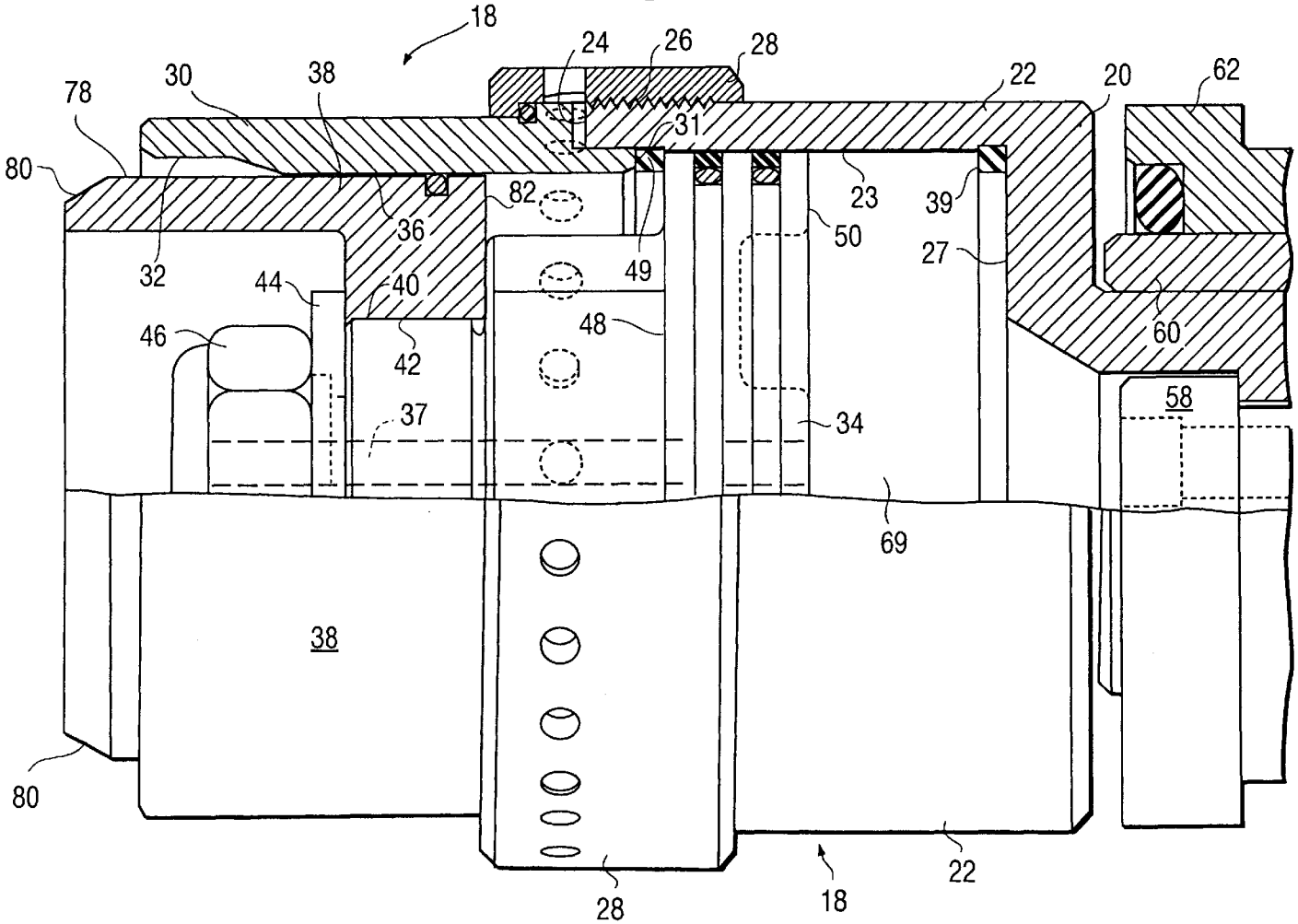
FIG. 1A is an enlarged partially bisecting view of a portion the floating piston, necking die, pilot and tool carrier member at time $T_1$ in the retracted cycle start position shown in FIG. 1.

The pilot 38 is of cylindrical configuration and is positioned internally of necking die 30 so as to be moveable axially with respect to the necking die between a forwardmost (leftward) position relative to the necking die 30 shown in FIGS. 1 and 1A and in a rearward limit position limited by engagement of floating piston 34 with plastic cushion washer 39.

Figure 8:
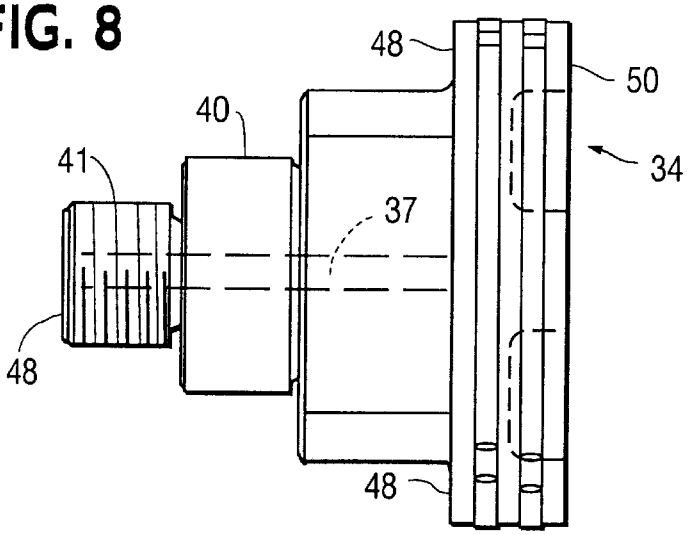
FIG. 8 is a side view of the floating piston on which the pilot is mounted.

The pilot 38 is mounted on a cylindrical support surface 40 provided on floating piston 34 as best shown in FIGS. 1A and 8. The pilot 38 has an axially parallel cylindrical 5 surface 42 fitted over support surface 40 of piston 34 as best shown in FIG. 1A. Pilot 38 is retained in position on the floating piston 34 by an annular retainer plate or washer 44 and a threaded retainer nut 46 which is threaded onto the threaded surface 41 (FIG. 8) of the floating piston 34. Floating piston 34 also includes an axial bore 37 (FIG. 8) extending from the forward end 48 to the rearmost end 50 of floating piston 34 as shown in FIG. 8. Axial bore 37 serves as an air passageway for providing compressed air for moving and holding the bottom 13 of container workpiece 12 against stop 16 and for pressurizing the interior of container workpiece during the necking operation in a manner to be discussed.

Tool carrier 20 has a rearwardly extending axial stem 52 including a threaded outer surface 54 (FIG. 3) and an axial bore 56 in which a threaded machine bolt 58 having an axial bore 59 is positioned. The bore 59 serves as an air passageway for providing compressed air to air chamber 69 of cylinder 22 in which floating piston 34 is positioned. The rearwardly extending axial mounting stem 52 is fixedly positioned in an axially moveable ram 60 mounted for reciprocation in a slide bearing 62 which is in turn mounted on the continuously rotating turret T carried by the rotating main drive shaft S, both of which are shown in FIG. 9. The turret is rotated in unison with the starwheel 14 by virtue of the fact that both the starwheel and the turret are supported on the main drive shaft.

Moveable ram 60 is reciprocated back and forth in slide bearing 62 by cam followers 64 mounted on the rear end of the moveable ram and engaged with a fixedly positioned cam member 66 is shown in FIGS. 1 and 2. Cam member 66, the front and drive shaft are of the type employed in the Model 595 necker produced and sold by Belvac Production Machinery, Inc. of Lynchburg, Va.

An axial air passage way 68 provided internally of moveable ram 60 extends forwardly from a conventional air coupling 72 to a chamber 70 which communicates with the axial air passage way 59 extending through threaded machine bolt 58. Additionally, the axial air passageway 68 communicates as its rearward end with the conventional air coupling 72 which is connected to schematically illustrated conventional rotary valve air control means 88 of the type employed in the aforementioned Model 595 necker. Rotary valve control means 88 is connected to low pressure air (approximately 20 psi) from low pressure source 90 and higher pressure air from a high pressure source 92 as schematically illustrated in FIG. 1. Rotary valve 88 provides either low pressure air from source 90 or high pressure air from source 92 to conduit 94 during an idle portion of the cycle of operation. Also, control valve means 88 additionally blocks both sources 90 and 92 from connection conduit 94 during a portion of each cycle of operation. Thus, rotary valve 88 provides timed delivery of compressed air to air chamber 69 defined by cylindrical bore surface 23 and the rearward face of piston 34 in conjunction with the forwardly facing surface 27 of the carrier member 20. The rearwardly extending mounting stem 52 of the tool carrier member 20 is retained in ram 60 by external threads 54 which are threadably engaged with internal threads 55 of ram 60 and by threaded engagement of threads 61 on threaded machine bolt 58 with threads 71 (FIG.2) provided in the forward end of chamber 70. Thus, the tool carrier 20 is securely mounted within the forward end of ram 60.

Forward movement of floating piston 34 in pilot 38 relative to necking die 30 is limited by engagement of the forward surface 48 of piston 34 with an annular cushion washer 49 positioned adjacent the rearmost annular extent 31 of the necking die 30 as best shown in FIG. 1A. Rearward movement of the floating piston 34 is cushioned by cushion washer or stop means 39 which is positioned adjacent the forwarding facing rear surface 27 of air chamber 69.

It should be noted that pilot 38 has a cylindrical outer surface 78 which terminates at its forward end at a conical surface 80, cylindrical outer surface 78 terminates rearwardly at a radial stop surface 82 as shown in FIG. 1A. The rearmost cylindrical portion 84 of the pilot extending rearwardly from stop surface 82 is of a slightly larger diameter than surface 78. The foregoing structure permits the forward end edge 15 (FIGS. 3 and 4A) of a container workpiece 12 to engage surface 82 to stop forward movement of pilot 38 during the necking procedure in a manner explained in greater detail in the following paragraphs.

A complete cycle of operation will now be discussed with initial reference to FIGS. 1, 1A, and 3A which illustrate the parts in the start position at time $T_1$ in which the ram 60 is in its fully retracted position and is positioned for beginning its forward movement toward the container workpiece 12. Compressed air is supplied from coupling 72 at a low pressure of approximately, but not limited to, 20 psi through axial air passageway 68, chamber 70 and air passageway 59 into air chamber 69. The air pressure in air chamber 69 consequently acts on surface 50 of piston 34 to urge the piston forwardly (to the left) so that the forward surface 48 of the piston is held in engagement with cushion washer 49 on necking die 30 while cam 66 initiates forward movement of ram 60. A portion of the air in chamber 69 is exhausted through air passageway 37 in floating piston 34 into the interior of the container workpiece 12 to shift and/or hold the container against the radial stop or backup 16 on the starwheel in the embodiment of FIGS. 1 through 8.

The forward movement of ram 60 causes tool carrier member 20 and necking die 30 to move forwardly toward the workpiece 12 and the pressurized air in chamber 69 continuously acts on piston 34 to keep the pilot urged against cushion washer 49 so that the pilot 38 follows the necking die and moves forwardly in unison with the necking die. Thus, necking die 30 and pilot 38 remain in the relative position with respect to each other illustrated in FIGS. 1 and 1A during the initial forward movement of the necking die from its FIG. 1 position. Chamber 69 is continuously connected through axial passageway 68 to the low pressure source 90 of air pressure so that the air pressure is maintained in chamber 69 notwithstanding the fact that portion of the air is vented forwardly through axial bore 37 extending length wise of the floating piston 34.

Figure 3:
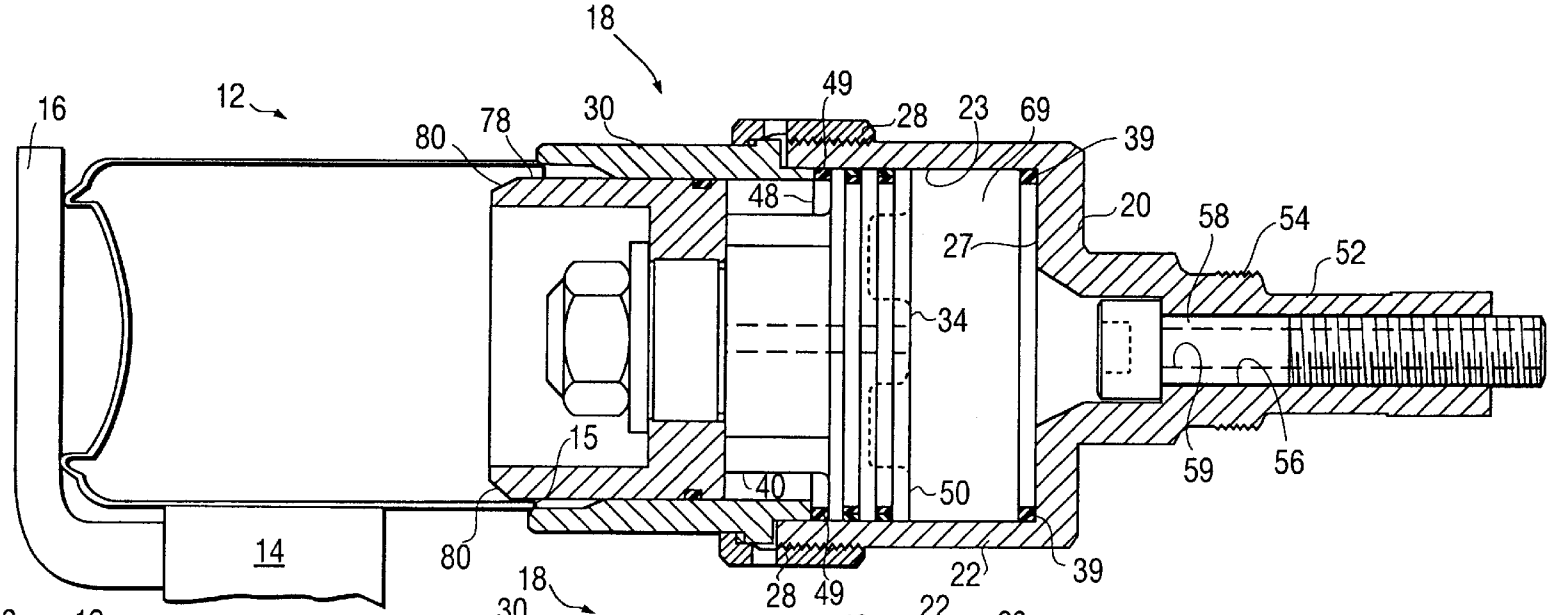
FIG. 3 is a sectional view at a time $T_2$ subsequent to $T_1$ illustrating the moment of engagement of the necking die with the end of the container workpiece.
Figure 4:
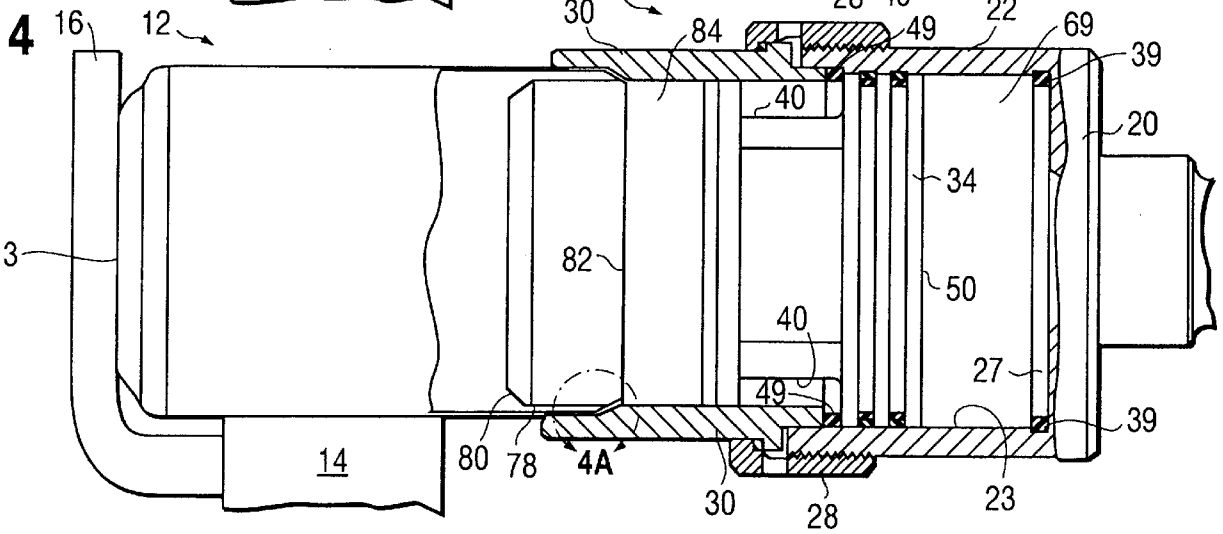
FIG. 4 is a sectional view similar to FIG. 2 at time $T_3$ subsequent to time $T_2$ illustrating a subsequent position of the pilot and necking die at the moment the can top edge engages the radial stop surface on the pilot to terminate forward movement of the pilot.
Figure 5:
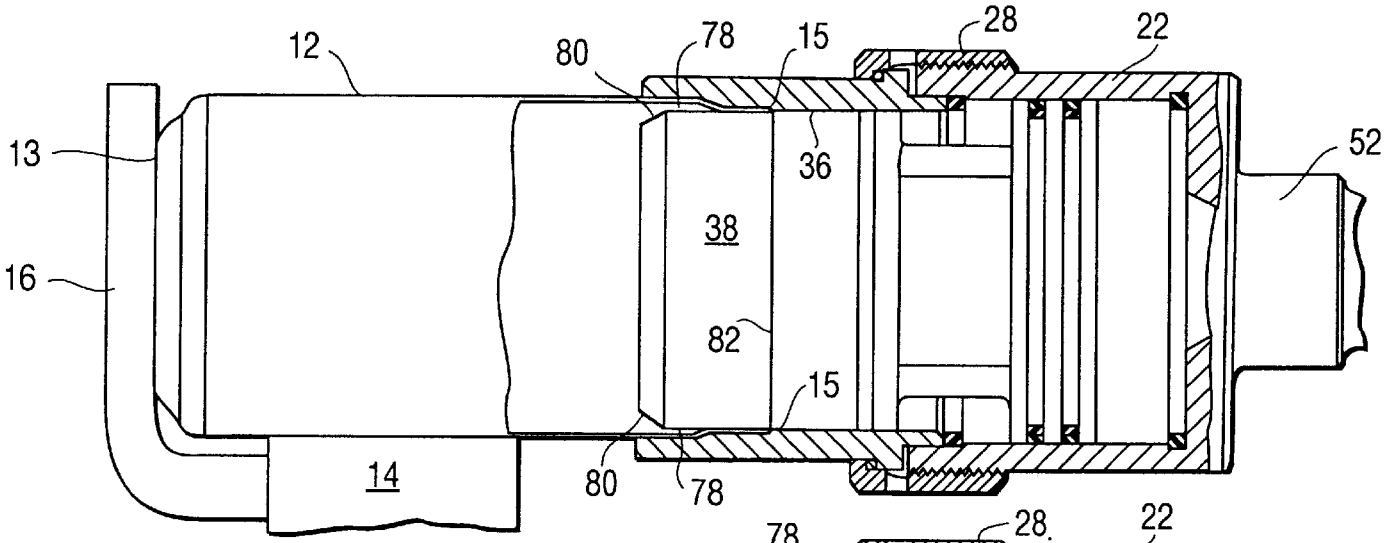
FIG. 5 is a sectional view similar to FIG. 4A at time $T_4$ subsequent to $T_3$ illustrating a subsequent intermediate position of the necking die and the pilot with the necking die having moved forward from the FIG. 4 position relative to the axially stationary pilot.
Figure 4A:
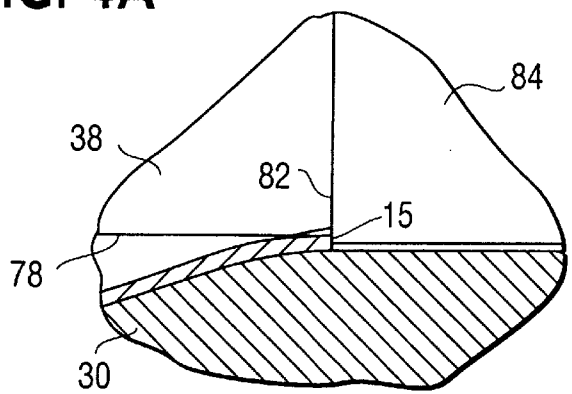
FIG. 4A is an enlarged view of the encircled portion 4A of FIG. 4 illustrating the moment of contact at time $T_3$ of the container workpiece end edge with the radial stop surface on the pilot.

At time $T_2$ the end edge 15 of container workpiece 12 is contacted by necking die 30 as shown in FIG. 3 This positioning of the workpiece terminates venting of the air discharged from the left end of axial bore 37 by providing a seal with die 30 and initiates pressurization of the interior of the container workpiece 12. Rotary valve 88 simultaneously provides higher pressure air from source 92 and causes the air pressure in the container workpiece 12 and chamber 69 to quickly increase to approximately, but not limited to, 40 psi to effect pressurization of the interior of the container workpiece 12. The container workpiece is consequently stressed and inflated to provide additional strength and rigidity thereto during the necking procedure which begins with contact of the workpiece 12 with the inner work surface 32 of necking die 30 as shown in FIG. 4.

Continued movement of the necking die 30 and the pilot 38 in the forward direction results in inward necking of the container workpiece neck so that the end edge 15 of the workpiece is moved inwardly into contact with the outer surface 78 or pilot 38 with such contact being at time $T_3$ shortly after time $T_2$. Pilot 38 continues to move forward in unison with necking die 30 until the forward end edge 15 of the workpiece container 12 engages radial surface 82 on the pilot at time $T_4$. Pilot 30 and floating piston 34 consequently immediately stop forward movement; however, necking die 30 continues to move forwardly under the control of cam 66. Since air is no longer vented, the pressure inside the container and in air chamber 69 quickly equalizes. This is possible since air pressure on both sides of floating piston 34 has been equalized due to the sealing of the workpiece 12 to the die 30. With the force due to air pressure on the piston being eliminated, the piston and hence pilot 38 remain stationary to workpiece 12 allowing the die 30 to complete the forming process.

Figure 6:
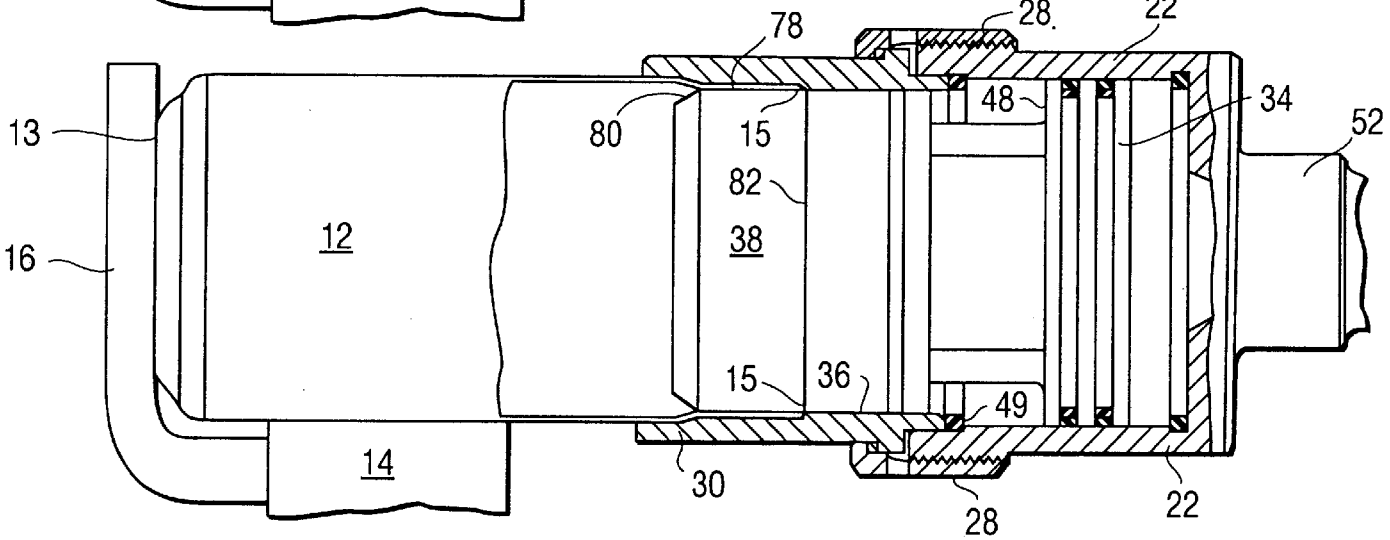
FIG. 6 is a view similar to FIG. 5 at time $T_1$ subsequent to $T_4$ illustrating a subsequent position of the necking die in its forwardmost position at the completion of the necking function and immediately prior to initiation of rearward movement of the necking die.
Figure 7:
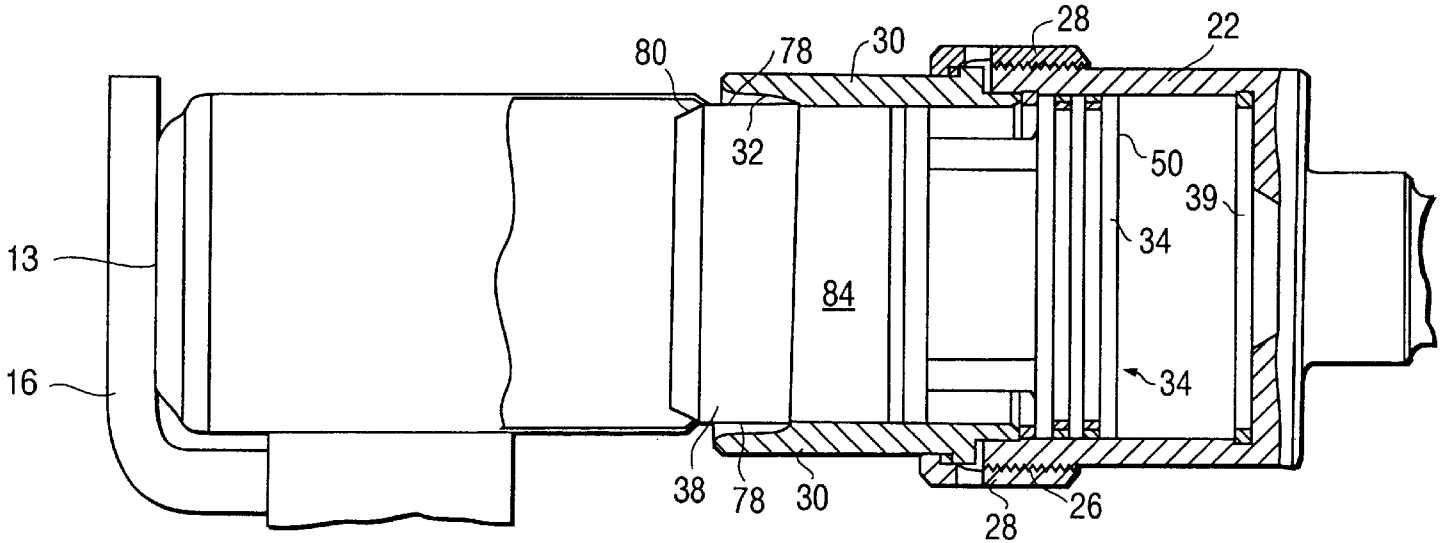
FIG. 7 is a view similar to FIG. 5 at time $T_6$ subsequent to $T_5$ illustrating a subsequent position of the necking die and pilot as the necking die and pilot move rearwardly while the can is being ejected by air pressure from the pilot to subsequently clear contact with the container workpiece.

Necking die 30 reaches its forward limit of movement illustrated in FIG. 6 at Time $T_5$ and immediately begins rearward movement under the control of cam 66. As the necking die moves rearwardly, the air pressure in the container workpiece maintains the base of the container workpiece in contact with the radial backup member 16 so as to strip the workpiece from the necking die 30 as the necking die moves rearwardly.

At time $T_6$ the workpiece 12 is disengaged from necking die 30 as described in the previous paragraph. The seal between 12 and 30 is now broken and the air vented to atmosphere. The pressure is no longer equalized across piston 34, causing the piston to be urged under air pressure in chamber 69 to return to the starting position with forward surface 48 of floating piston 34 again in contact with cushion washer 49 as shown in FIG. 1A.

The pressure in air chamber 69 is reduced to the lower pressure of approximately 20 psi and the supply of compressed air is terminated completely as the necking die reaches the home or starting position at time $T_8$. The process is then repeated.

The second embodiment of the invention which is illustrated in FIG. 9 operates in a reverse manner from the first embodiment. More specifically, the second embodiment employs a plurality of necking dies 130 that are fixedly attached to turret T and are not axially moveable relative to the turret. Pilots 138 are positioned for limited axial movement in each necking die. The necking dies 132 are essentially identical to dies 32 of the first embodiment and pilots 138 are essentially identical to pilots 38 of the first embodiment. Additionally, the second embodiment employs an axially moveable workpiece pusher 116 which is reciprocated toward and away from an axially fixedly positioned necking die 130 during each cycle of operation. Workpiece pusher 116 is mounted on a ram 160 positioned in a slide bearing 162 as shown in FIG. 9. Ram 160 is reciprocated by cam followers 164 engageable with a cam 166 as shown in FIG. 9. It should be noted that the uppermost workpiece pusher 116 shown in FIG. 9 is in its forwardmost position relative to necking die 130 whereas the lower workpiece pusher 116 shown in FIG. 9 is in its retracted position.

The components 116, 130, etc. are mounted for rotation on turret T which is supported by main shaft S as shown in FIG. 9. Additionally, starwheel means 114 is positioned between the pusher 116 and the necking die 130 for supporting the workpieces in a well known conventional manner. The workpieces are supported on starwheel 114 in axial alignment with necking die members 130 in the manner of the first embodiment.

Figure 10:
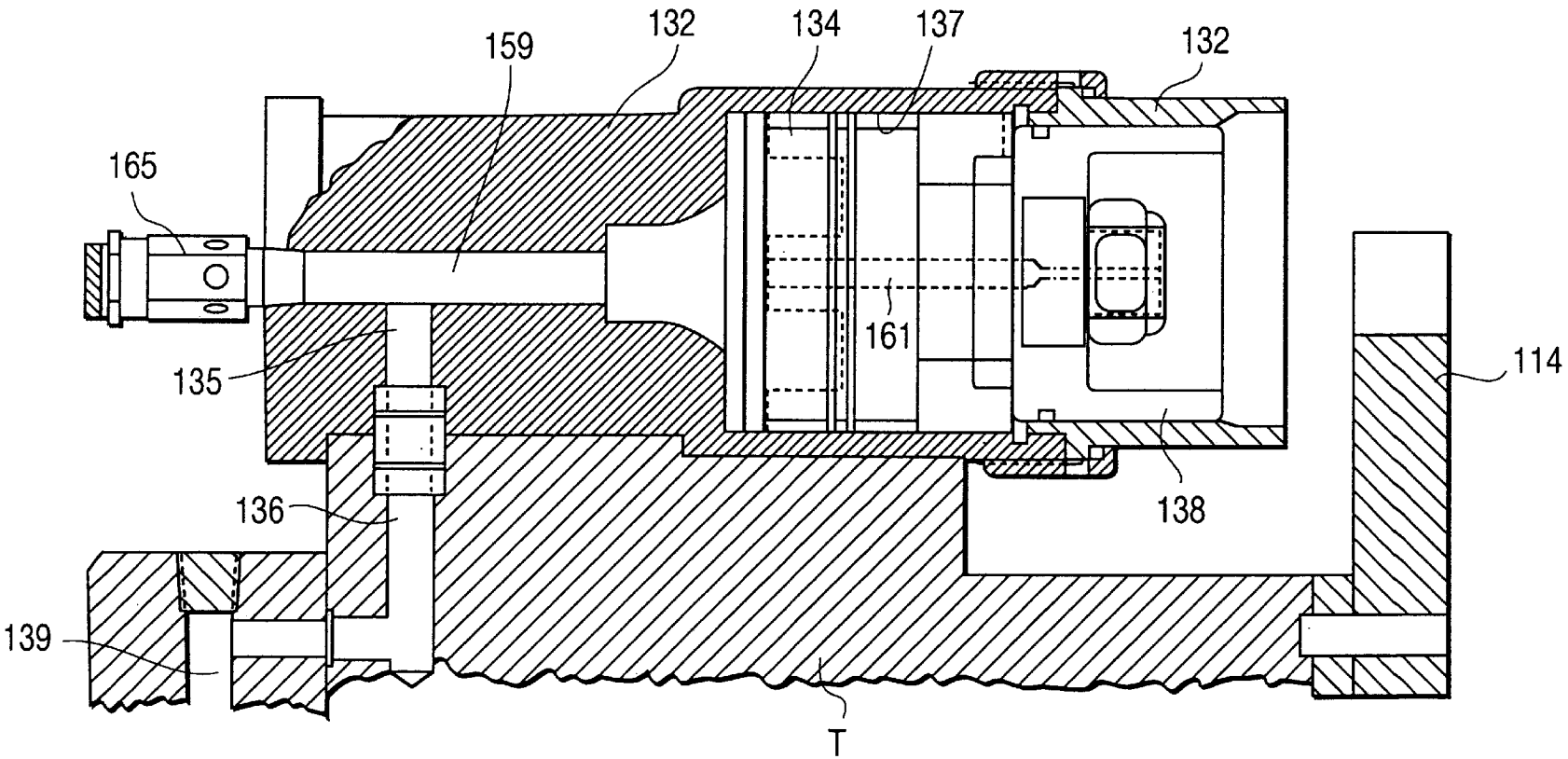
FIG. 10 is an enlarged portion of FIG. 9.

Attention is invited to FIG. 10 of the drawings which illustrates the necking die support 132 which is fixedly attached to turret T. Support 132 includes an axial bore 159 and a radial bore 135 connected thereto. Radial bore 135 communicates with a radial bore 136 in turret T which in turn communicates with an air line 139 communicating with rotary valve 188 which receives either low pressure air from source 190 or high pressure air from source 92.

A floating piston 134 is provided in bore 137 in fixedly positioned necking die support member 132. The floating piston supports a pilot 138. Pilot 138 is capable of relative movement with respect to necking die 130 in exactly the same manner as pilot 38 of the first embodiment is supported in cylindrical portion 22. Pressurized air is provided through means 139, 136, 135 and 159 to enter the left end of the cylinder 137 to urge the piston 134 to the right. The structure of pilot 138, the necking die 130 and piston 134 is essentially the same as the corresponding elements of the first embodiment with the exception of the fact that 138 does not include a radial surface 82.

It should be noted that the relative movement of the components of the second embodiment is precisely the same as the relative movement of the components of the first embodiment. However, such relative movement is accomplished by moving the workpiece toward the necking die as opposed to the operation of the first embodiment in which the necking die is moved toward the workpiece.

In any event, a cycle of operation of the second embodiment begins with movement of the workpiece pusher 116 from its retracted position to the left toward the necking die 130 so as to move the forward open end of the workpiece into contact with the necking die at which time the workpiece and necking die and pilot are in the same relative positions as in FIG. 3. At the beginning of a cycle of operation at time $T_1$, low pressure air from source 139 is supplied through bore 159 to the left side of the piston 134 so as to urge the piston to the right and position the pilot relative to necking die 130 in the same relative position as that shown in FIG. 1A of the first embodiment. Since floating piston 134 includes an air passageway 161 communicating the left end of the piston to the interior of pilot 138 through axial bore means 159, the interior of the workpiece can be pressurized or vented during a cycle of operation. Such engagement of the workpiece with the necking die prevents the venting of air from the workpiece which is consequently pressurized. Simultaneously, rotary valve 88 provides higher pressure air from source 92 so that the pressure within the workpiece increases to approximately, but not limited to, 40 pounds per square inch to increase the workpiece rigidity during the necking procedure. The arrangement also seals the air pressure too because the forces on the piston allow the pilot to move as in the first embodiment. The pressure in the workpiece is limited by a pressure relief valve 165 which need not be employed if pressure in source 139 is maintained at a lower level.

Continued movement of the pusher 116 toward the workpiece results in inward necking of the workpiece so that the end edge 15 of the workpiece moves inwardly into contact with the outer surface 178 of the pilot during the initial contact of the workpiece with the necking die with the necking die and the container workpiece being in exactly the same relative position relative to each other as that shown in FIG. 4.

Continued forward movement of the workpiece pusher 116 results in the forward edge 15 of the workpiece container engaging the the pilot's outer surface. The continued movement of the workpiece relative to the pilot continues until the end of the stroke of pusher 116 to complete the necking function.

Air pressure is maintained in the workpiece as the workpiece pusher begins to move away from the container so as to strip the workpiece from the pilot and the necking die tube as it follows the workpiece pusher to effect its removal from the apparatus. Since the seal is broken between the workpiece and die, air vents to atmosphere allowing the pressure to move the pilot to the start position. Thus, it will be apparent that the necking procedure is essentially the same as that for the first embodiment.

Adjustable pressure release valve 167 is shown in the second embodiment of FIG. 10. This valve can be set so that any increase in the air pressure in chamber 168 can be vented to atmosphere. The additional air pressure is caused by the inward movement of piston 134 in reducing the effective volume of chamber 167 which would cause an increase in pressure were it not for the release valve. This pressure relief, although not fundamental to the forming process, enables the can to be formed with less pressure (force) exerted by workpiece pushes 116; this is important for lightweight cans to reduce the risk of dome end damage during the neck forming process, and can be used in both embodiments of the invention.

Modifications and variations of the above-described embodiments of the invention are possible without departing from the spirit and scope of the invention and will be obvious to those skilled in the art in light of the above teachings. It is therefore to be understood that the appended claims and their equivalents are the only limitations on the scope of the invention which may be practiced otherwise than as specifically described without departing from the spirit and scope of the invention.

What is claimed is:

1. A container necking apparatus comprising:

a container support for supporting a cylindrical container workpiece having an upper edge surface surrounding an open end and a closed bottom end; tooling facing said container support so as to be aligned with the open end of any cylindrical container positioned on said container support, said tooling including:

a necking die support including stop, a generally cylindrical necking die mounted on said necking die support for axial movement from a home position in a forward direction toward said container support and the open end of any cylindrical container supported thereon and having an inwardly facing working surface engageable at the outer end portion of such cylindrical container when moved in said forward direction for inwardly necking the open end of such cylindrical container;

a pilot mounted on said pilot support coaxially positioned in said generally cylindrical necking die for movement in said forward direction and for limited relative axial movement relative to said necking die, said pilot support including a forwardly facing follower surface on said pilot support which is engageable with said stop on said necking die support to preclude subsequent relative forward movement of the pilot relative to the necking die when said pilot is urged in said forward direction, a surface on said pilot engageable with the upper end edge surface of the container during a necking operation without inhibiting continued forward movement of the necking die; and mechanical drive for moving said necking die support in said forward direction toward the container support to bring the necking die into contact with the container and seal the interior of the container and initiate a necking operation on the container and then in a rearward direction away from the container for repositioning of necking die in its home position for a subsequent cycle of operation;

a pressurized air source providing pressurized air to the pilot support to urge the pilot in said forward direction and for pressurizing the interior of the container and for causing the pilot support to engage and stop as the necking die support moves in said forward direction to initiate the necking operation; and so that the forward motion of the pilot stops when the pressure of the pressurized air urging the pilot forward is equal to the pressure in the interior of the container.

2. A container necking apparatus as recited in claim 1 wherein said container support comprises a starwheel including a radially oriented member engaging the bottom of the container for preventing subsequent axial movement of the container in said forward direction beyond a proper position for being necked.

3. A container necking apparatus as recited in claim 1 wherein said mechanical drive comprises a fixedly position cam engaged by cam follower connected to said necking die.

4. A container necking apparatus as recited in claim 1 wherein said pilot support comprises a floating piston which is forwardly biassed by said pressurized air.

5. A container necking apparatus as recited in claim 4 wherein said floating piston is mounted in a cylindrical air chamber in said necking die support.

6. In a container necker of the type having a necking die assembly driven by a cam forwardly toward a container workpiece to be necked and a pilot assembly comprising a pilot and pilot support axially positioned within the necking die assembly, the improvement comprising air pressure actuated drive for urging the pilot assembly forwardly into contact with the necking die assembly so that the pilot moves in unison with the necking die toward the container and so that the forward motion of the pilot stops when the pressure of the pressurized air urging the pilot forward is equal to the pressure in the interior of the container.

7. A method of necking a container comprising:

(a) providing an open-topped container workpiece to be necked in axial alignment with a necking die and a pilot which are positioned in a home position; and (b) moving the necking die relatively forward axially with respect to the container workpiece while simultaneously moving the pilot forwardly by the application of pressurized gas on one portion of the pilot with the movement of the necking die and the pilot being of sufficient extent to effect the necking of the container, and (C) stopping the forward motion of the pilot when the pressure of the pressurized air urging the pilot forward is equal to the pressure in the interior of the container.

8. The method of claim 7 wherein said moving of the necking die is effected by mechanical drive.

9. The method of claim 7 including the step of:

(c) terminating forward movement of the pilot while the necking die continues to move forwardly to complete the necking of the container.

10. The method of claim 9 including the subsequent step of:

(d) reducing gas pressure on the pilot so that the pilot is free to move rearwardly and moving the necking die rearwardly in contact with the pilot to effect positioning of the pilot in its home position.

11. The method of claim 7 including providing pressurized gas through the pilot into the container workpiece for pressurizing the container workpiece during step (b).

12. The method of claim 7 including the step of providing pressurized gas through the pilot into the container workpiece for pressurizing the container and equalizing gas pressure on the pilot during step (b).

13. A method of necking a container workpiece comprising:

(a) positioning a container workpiece to be necked in axial alignment with a necking die assembly and a pilot die mounted on a pilot die support for limited axial movement relative to and in the necking die assembly said necking die assembly and pilot die being positioned in a home position;

(b) effecting relative movement of the necking die assembly and the container while simultaneously applying air pressure against the pilot die support for urging the pilot die forward toward a forward position relative to the necking die; and (c) terminating forward movement of the pilot relative to the necking die in response to engagement of a portion of the pilot die support with the necking die assembly while continuing relative movement of the necking die and the container workpiece to complete the necking operation; and stopping the forward motion of the pilot when the pressure of the pressurized air urging the pilot forward is equal to the pressure in the interior of the container.

14. A container necking apparatus comprising:

a workpiece support for supporting a cylindrical container workpiece having an upper end edge surface surrounding an open end and a closed bottom end for axial movement;

a workpiece positioning member for axially positioning said cylindrical container workpiece; tooling facing said workpiece support so as to be aligned with the open end of a cylindrical container workpiece positioned on said workpiece support; said tooling including:

a necking die support having a rearwardly facing surface; a generally cylindrical fixedly positioned necking die mounted on said necking die support and aligned with the open end of a cylindrical container workpiece on the workpiece positioning and having an inwardly facing working surface engageable at the outer end portion of such cylindrical container workpiece in response to relative axial movement of the necking die support and the container workpiece; a pilot mounted on pilot support coaxially positioned in said generally cylindrical necking die for limited relative axial movement relative to said necking die; said pilot support including a forwardly facing surface on said pilot support being engageable with said rearwardly facing surface of said necking die support to limit relative forward movement of the pilot relative to the necking die; an outer surface of said pilot being engageable with the open end of the container workpiece during a necking operation for inhibiting continued relative forward movement of the pilot with respect to the container workpiece and the necking die, and mechanical drive for effecting movement of the container into contact with said necking die to seal the interior of the container and to initiate a necking operation on the container and then in a rearward direction away from the necking die for repositioning in its home position for a subsequent cycle of operation; and a pressurized air source providing pressurized air to the pilot support to urge the pilot toward and into contact with the container and for pressurizing the interior of the container and for causing the pilot support to engage the rearwardly facing surface of the necking die support to terminate movement of the pilot toward the workpiece;

so that the forward motion of the pilot stops when the pressure of the pressurized air urging the pilot forward is equal to the pressure in the interior of the container.

15. A container necking apparatus as recited in claim 14 wherein said container support comprises a starwheel and said workpiece positioning comprises pusher engageable with the bottom of the container workpiece for effecting movement of the container workpiece relative to said starwheel to move the container workpiece toward the necking die support.

* * * * *